US005213485A

United States Patent [19]

Wilden

[11] Patent Number: 5,213,485

[45] Date of Patent: May 25, 1993

[54] AIR DRIVEN DOUBLE DIAPHRAGM PUMP

[76] Inventor: James K. Wilden, 11727 Pendleton, Yucaipa, Calif. 92399

[21] Appl. No.: 790,336

[22] Filed: Nov. 19, 1991

Related U.S. Application Data

[62] Division of Ser. No. 321,889, Mar. 10, 1989, Pat. No. 5,169,296.

[51] Int. Cl.[5] ..... F04B 39/10

[52] U.S. Cl. ..... 417/393; 417/395; 417/454; 137/454.4

[58] Field of Search ..... 417/393, 395, 454; 137/454.4, 454.6

[56] References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| 3,071,118 | 1/1963 | Wilden | 121/157 |
| 4,123,204 | 10/1978 | Scholle | 417/393 |
| 4,247,264 | 1/1981 | Wilden | 417/393 |
| 4,549,467 | 10/1985 | Wilden et al. | 417/393 |
| 4,597,721 | 7/1986 | Santefort | 417/393 |
| 4,778,356 | 10/1988 | Hicks | 417/397 |
| 4,974,628 | 12/1990 | Tepermeister et al. | 137/454.4 |

*Primary Examiner*—Richard A. Bertsch
*Assistant Examiner*—David W. Scheuermann
*Attorney, Agent, or Firm*—Lyon & Lyon

[57] ABSTRACT

A double diaphragm pump having an air chamber housing centrally located between two water chamber housings. The air chamber housing includes a center section and two outwardly facing concave discs. Each water chamber housing includes a water chamber shell mating with one of the discs with a flexible diaphragm therebetween. Also included integrally formed with the water chamber housing are check valve chambers and inlet and outlet passages. The passages of one water chamber mutually converge with the passages of the other water chamber to receive T-couplings for providing both inlet to and outlet from the pump. O-rings are held in interference fit between the T-couplings and the mutually converging portions of the inlet and outlet passages. Shoulders on the T-couplings and portions keep the O-rings in place. Spacing inserts are employed in each passage to locate either a valve seat or a ball check valve and to close off access openings through the wall of the chamber. Two clamp bands are positioned about the mating peripheries of the discs and water chamber shells to hold the entire unit in the assembled condition.

8 Claims, 2 Drawing Sheets

AIR DRIVEN DOUBLE DIAPHRAGM PUMP

This is a division, of application Ser. No. 321,889, filed Mar. 10, 1989, now U.S. Pat. No. 5,169,296.

BACKGROUND OF THE INVENTION

The field of the present invention is the structure of air driven diaphragm pumps.

Pump apparatus which employ compressed air through an actuator valve to drive double diaphragms are well known. Disclosures of such devices are found in U.S. Pat. No. 247,264, U.S. Pat. No. Des. 294,946, U.S. Pat. No. Des. 294,947, and U.S. Pat. No. Des. 275,858, all issued to James K. Wilden. An actuator valve used with such air driven diaphragm pumps is disclosed in U.S. Pat. No. 3,071,118 issued to James K. Wilden. All of the foregoing patents are incorporated herein by reference.

Common to the aforementioned patents on air driven diaphragm pumps is the presence of an air chamber housing having a center section and concave discs facing outwardly from the center section, water chamber housings, an inlet manifold and an outlet manifold. Ball check valves are also positioned in both the inlet passageways and the outlet passageways. The check valve chambers are defined with ribs or other restrictions typically cast into the components to maintain the ball check valves in position. Seats are provided which may be inserts or integral with the components depending on material and fabrication techniques. Diaphragms located between the air chambers and water chambers reciprocate back and forth under the influence of air pressure directed alternately to one side or the other of the pump. This action in combination with the check valves provides for the pumping of a wide variety of materials.

SUMMARY OF THE INVENTION

The present invention is directed to an air driven double diaphragm pump and the structure thereof. Structures are contemplated which provide fewer opportunities for leakage, fewer components and less complicated assembly.

In a first aspect of the present invention, water chamber housings are provided which are integrally formed including the shell itself, dual check valves and passageways leading to and from the check valves. Thus, with the addition of the air chamber housing, only three principal body parts are required for a double diaphragm pump, the air chamber housing and two water chamber housings. Additional accommodations are provided by spacing inserts and seats. Sealing of the units becomes comparatively easy through strategically placed O-rings. Further, fastening of the device requires only compression of the water chamber housings against the air chamber housing.

In a second aspect of the present invention, inlet and outlet passages integrally formed with the water chamber housings mutually converge to establish common inlet and outlet manifolds with a minimum of sealed joints and components. A T-coupling may be employed as a simple and flexible mechanism for coupling to suction or exhaust lines associated with the pump.

In a third aspect of the present invention, a T-coupling may be arranged with two converging lines using a telescoping assembly and O-ring seals. Opposed shoulders locate the O-rings. Such a system allows longitudinal movement between the lines and also accommodates rotation of the T-coupling for convenient use.

Accordingly, it is an object of the present invention to provide improved structures for air driven double diaphragm pumps. Other and further objects and advantages will appear hereinafter.

DETAILED DESCRIPTION OF THE PREFERRED EMBODIMENT

Figure 1:
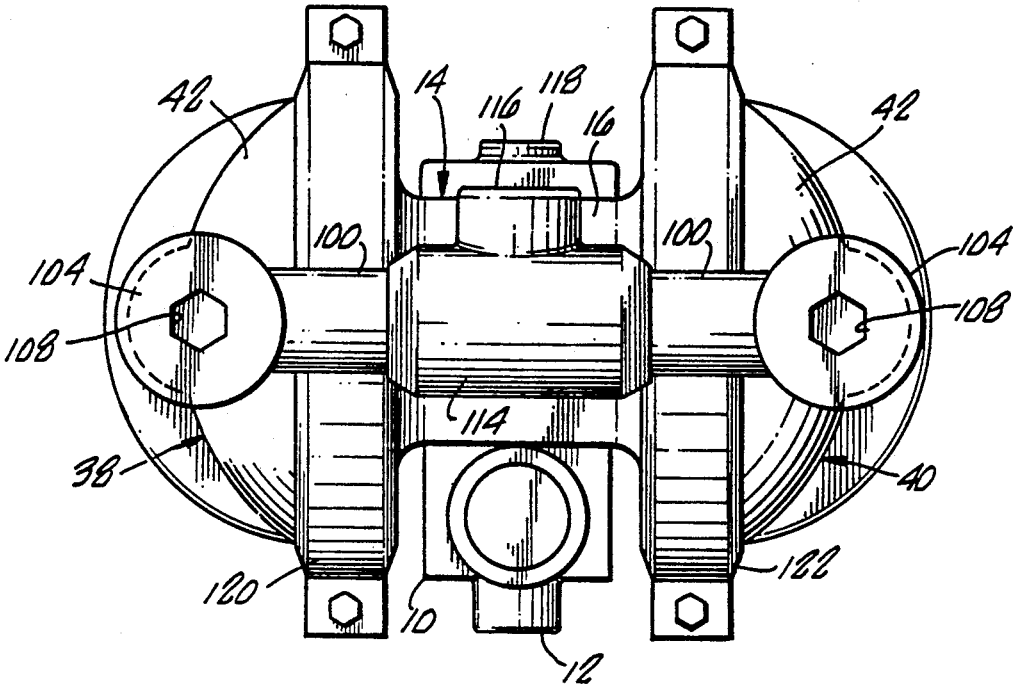
FIG. 1 is a plan view of a pump of the present invention.
Figure 2:
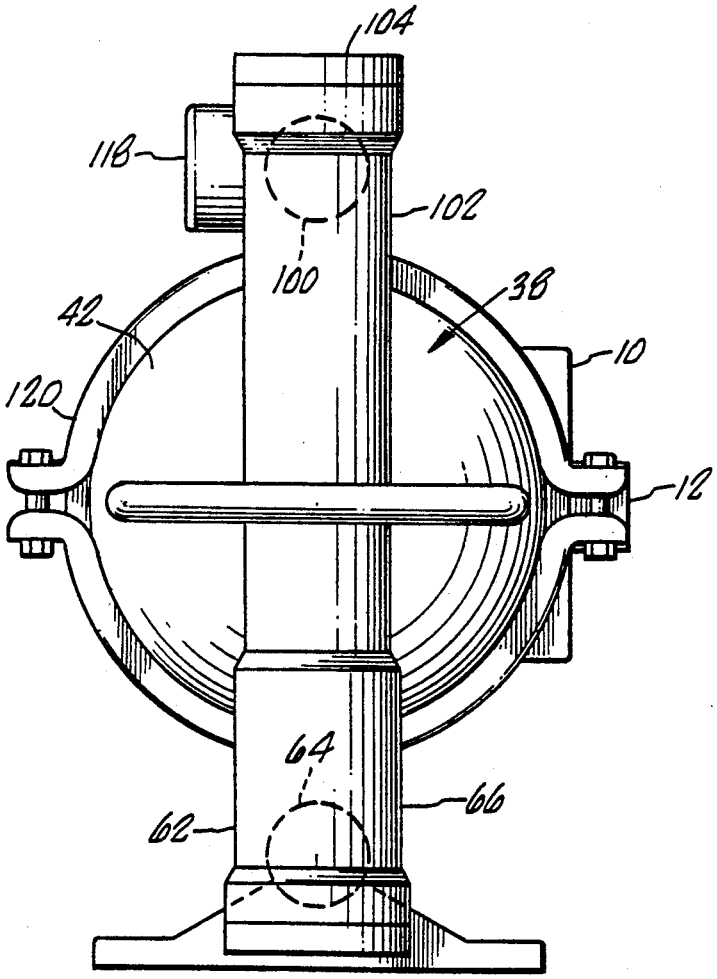
FIG. 2 is an end view of a pump of the present invention.

Turning in detail to the drawings, a double diaphragm air driven pump is illustrated which includes an actuator valve 10 that receives compressed air through an inlet 12 for alternating distribution to either side of the pump to induce reciprocal motion in the diaphragms. The actuator valve 10 is affixed by fasteners to the center of an air chamber housing, generally designated 14. A center section 16 of the air chamber housing 14 provides a mounting for the actuator valve which is tied therethrough to a back plate 18. The center section 16 also provides air passageways to a control rod 20 which is mounted in a bushing through the center section 16.

Figure 3:
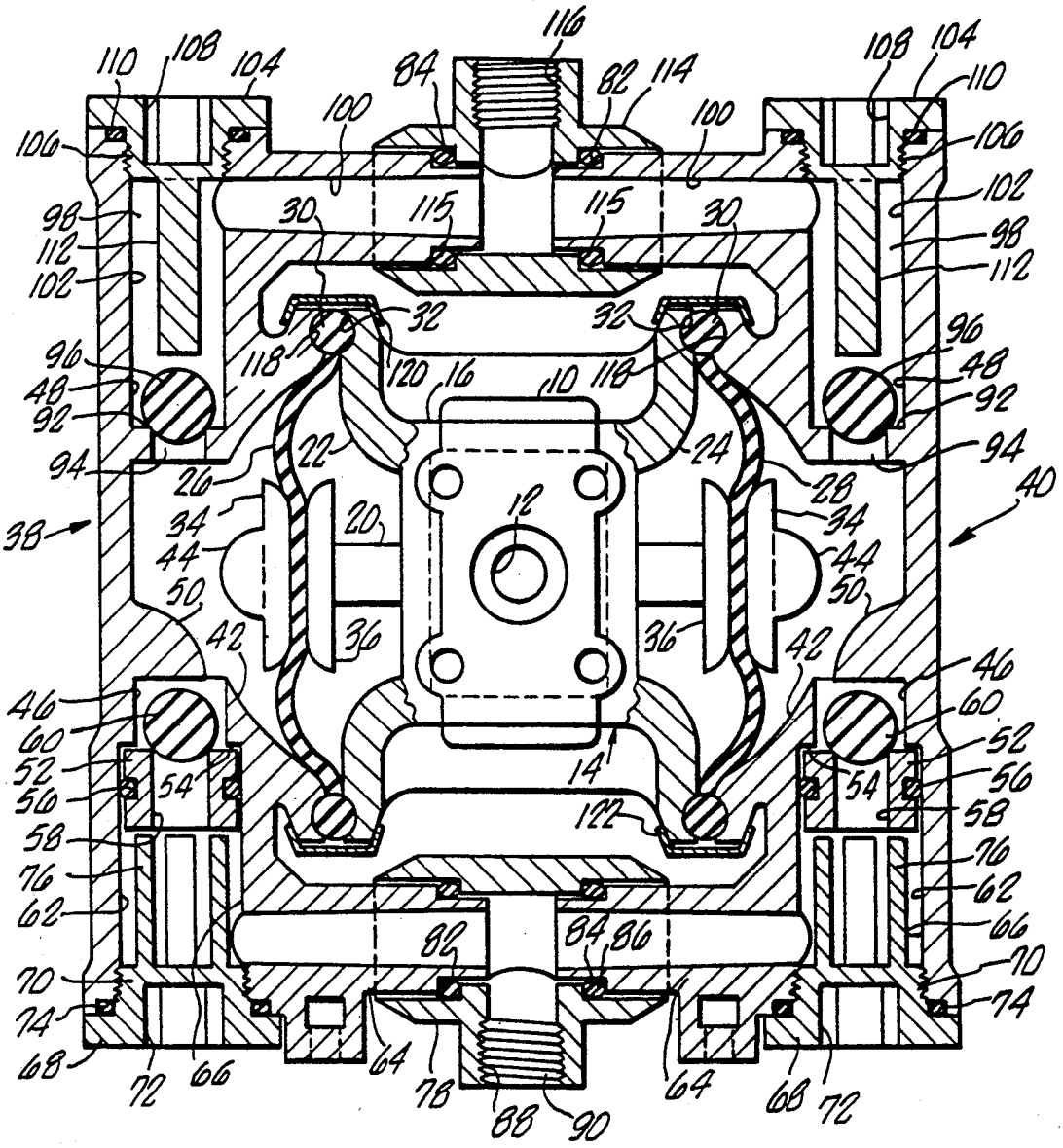
FIG. 3 is a cross-sectional side view taken through the center of the pump.

Integral with the center section 16 are two outwardly facing concave discs 22 and 24 which define air chamber shells extending to circular peripheries. The profile of each disc 22 and 24, as seen in FIG. 3, is preferably configured such that the diaphragm will lie close to the disc surface in a preferred orientation when the control rod 20 is at the end of its stroke toward the other side of the pump. Flexible diaphragms 26 and 28 extend across each of the discs 22 and 24 to the peripheries thereof. The diaphragms 26 and 28 each include a circular bead 30 about the peripheries which is sized to mate with the peripheries of the discs 22 and 24 in grooves 32. The diaphragms 26 and 28 are tied to the control rod 20 by means of mounting plates 34 and 36

Two water chamber housings, generally designated 38 and 40, are positioned to either side of the air chamber housing 14. The water chamber housings 38 and 40 can be identical. Each includes a water chamber shell 42 which defines a cavity to one side of the flexible diaphragm opposite to the air chamber. The wall of the shell 42 may advantageously be arranged such that the diaphragm comes into close proximity thereto when the control rod 20 is at its full extent toward the shell. Room is also provided to accommodate the end cap 44 on the control rod 20.

Integrally formed with each water chamber housing 38 and 40 are two check valve chambers 46 and 48. These check valve chambers 46 and 48 are in direct communication with the interior of the water chamber shell 42. The lower check valve chamber 46 is associated with the pump inlet. A stop 50 defines one side of the check valve chamber 46. The stop is relatively thin in cross section such that influent may easily pass thereabout. The other side of the check valve chamber 46 from the stop 50 is defined by a seat insert 52. The seat insert 52 is pressed into contact against a shoulder 54 at one end of the check valve chamber 46. An O-ring 56 seals the seat insert 52 from passage of material other than through the central orifice 58 through the seat insert 52.

A ball check valve 60 is positioned in the check valve chamber 46. The ball does not fill the chamber in order that influent may flow around the ball into the pump without substantial resistance. The ball 60 is retained from exiting the check valve chamber 46 because of the stop 50. The ball 60 also is sized to be received properly by the seat insert 52 for closure of the valve when the water chamber associated therewith is in the pressure stroke.

An inlet passage 62 extends to the check valve chamber 46. An inlet passage 62 is integrally formed in each of the water chamber housings 38 and 40. The passage 62 includes a first portion 64 which extends inwardly toward the centerline of the pump. Two first portions 64, one associated with each of the two water chamber housings 38 and 40, are thus mutually convergent toward the centerline of the pump. A second portion 66 extends at substantially a right angle to the first portion 64. This second portion 66 is conveniently formed to extend outwardly of either pump chamber housing 38 and 40 for ease of fabrication and assembly. At its outer extent beyond the connection with the first portion 64, the second portion 66 is threaded. A spacing insert 68 is positioned in this second portion 66 and threaded into a fixed position therewith. The spacing insert 68 includes a plug 70 having a hexagonal cavity 72 for placement and removal of the spacing insert 68. External threads mate with the internal threads of the housing and an annular cavity is provided for an O-ring seal 74. The spacing insert 68 includes fingers 76 which extend inwardly through the second portion 66 of the inlet passage 62 to locate and retain the seat insert 52. The fingers 76 are spaced apart and displaced from the wall of the passage in order that communication is uninhibited between the first and second portions 64 and 66 and between the second portion 66 and the orifice 58 of the seat insert 52.

Positioned over the ends of the mutually convergent first portions 64 of each water chamber housing 38 and 40 is an inlet T-coupling 78. The end of each first portion 64 has a first, generally cylindrical surface at a reduced diameter to the main body of the first portion 64 to form a shoulder 82. The T-coupling 78 includes a stepped inner surface to also define a shoulder 84. An O-ring seal 86 is located between the shoulders 82 and 84. Each O-ring seal 86 is preferably in interference fit with both the T-coupling 78 and a water chamber housing 38 or 40. The pressure experienced by the O-ring 86 causes it to move and deform in the space between the shoulders 82 and 84 to seal the joint. This arrangement allows accommodation of fairly large manufacturing tolerances in the components. Further, the pump can experience some expansion and contraction as it operates. This movement can cause the water chamber housings 38 and 40 to move longitudinally relative to one another. The telescoping assembly of the T-coupling 78, the water chamber housings 38 and 40 and the O-rings 86 accommodates such movement. The T-coupling is also able to pivot about its axis to locate a port as may be most convenient.

A port 88 extends laterally from the T-coupling 78. This port 88 may be internally or externally threaded or may include a coupling flange or other desired conventional coupling arrangement. The T-coupling 78 of the preferred embodiment includes interior threads 90 in the port 88.

The check valve chamber 48 associated with the outlet of the pump includes a seat 92 which is conveniently integral with the housing. An orifice 94 provides communication between the water chamber and the check valve chamber 48. A ball check valve 96 controls flow therethrough in a conventional manner.

Extending outwardly from the check valve chamber 48 is an outlet passage 98. The outlet passage 98 also includes a first portion 100 extending inwardly toward the centerline of the pump. A second portion 102 extends from the check valve chamber 48 to the first portion 100. The first and second portions 100 and 102 are similarly configured to the first and second portions 64 and 66 of the inlet. Located in the extension of the second portion 102 opening through the housing is a spacing insert 104. The spacing insert 104 includes a plug 106 having a hexagonal cavity 108 for forced removal and placement of the insert 104. The plug 106 is threaded as is the housing for rigid placement of the insert 104. An O-ring seal 110 fully closes the opening through the housing. The spacing insert 104 includes a single centrally aligned finger 112 which extends downwardly to the check valve chamber 48 to constrain the ball valve 96 to remain in the chamber.

Arranged in a substantially identical manner to the T-coupling 78 of the inlet portion of the pump is a T-coupling 114 serving as an outlet. This coupling also extends over the ends of the second portions 102 of the outlet passage 98 and is able to pivot thereabout for convenience of discharge. The T-coupling 114 is sealed by O-rings 115 also in an identical manner to the inlet T-coupling 78. A threaded port 116 provides for easy attachment of exhaust conduits.

Assembly of the pump itself is facilitated by the structure disclosed. Mating with the periphery of the discs 22 and 24 and the flexible diaphragms 26 and 28 is the shell 42 of each water chamber housing 38 and 40. Circular grooves 118 accommodate the beads 30 of the flexible diaphragms 26 and 28 in the same manner as the grooves 32. Components of the pump may simply be stacked from one side to the other for facile assembly. To hold the entire assembly together, two clamp bands 120 and 122 are positioned about the peripheries of the discs 22 and 24 and the water chamber shells 42 and contracted thereabout to retain the elements in compression against the beads 30 of the flexible diaphragms 26 and 28. Through these two clamp bands 120 and 122, the entire pump is held together.

Accordingly, an air driven double diaphragm pump structure is disclosed which requires a minimum number of parts, seals and assembly steps. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A double diaphragm pump comprising an air chamber housing having a center section and two outwardly facing concave discs rigidly positioned to either side of said center section;

two water chamber housings fixed to said air chamber housing and mating with and about the periphery of said two outwardly facing concave discs, respectively, each said water chamber housing including a water chamber shell defining a water chamber, and first and second check valve chambers;

an inlet passage extending to and in communication with said first check valve chambers, said first check valve chambers being between said inlet passage and said water chambers, respectively, said inlet passage including inlet portions which extend from said water chamber housings, respectively, and are mutually convergent, each inlet portion having an end distant from the respective said water chamber housing, said ends of said inlet portions being mutually spaced apart;

an outlet passage extending to and in communication with said second check valve chambers, said second check valve chambers being between said outlet passage and said water chambers, respectively, said outlet passage including outlet portions which extend from said water chamber housings, respectively, and are mutually convergent, each outlet portion having an end distant from the respective said water chamber housing, said ends of said outlet portions being mutually spaced apart, each said inlet portion and each said outlet portion being of one piece construction with a said water chamber housing, respectively;

an inlet coupling extending to said ends of said inlet portions and being axially slidably mounted thereon and sealed therewith;

an outlet coupling extending to said ends of said outlet portions and being axially slidably mounted thereon and sealed therewith.

2. The double diaphragm pump of claim 1 further comprising fastening means including two clamp bands positioned about the periphery of each mating set of a said water chamber housing and a said air chamber housing concave disc, respectively.

3. The double diaphragm pump of claim 1 further comprising two diaphragms extending across each of said concave discs to the peripheries thereof, respectively.

4. The double diaphragm pump of claim 1 wherein said outlet coupling is a T-coupling.

5. The double diaphragm pump of claim 4 wherein said inlet coupling is a T-coupling.

6. The double diaphragm pump of claim 1 further comprising spacing inserts fixed in said inlet passage said first check valve chamber of each said water chamber housing including a seat insert, said spacing inserts extending into contact with said seat inserts to maintain said seat inserts against said first check valve chambers respectively.

7. The double diaphragm pump of claim 6 further comprising spacing inserts in said outlet passage extending to said second check valve chambers, respectively.

8. The double diaphragm pump of claim 7 further comprising ball check valves in said check valve chambers.

* * * * *